United States Patent [19]

Brown, Jr.

[11] Patent Number: 4,985,101

[45] Date of Patent: Jan. 15, 1991

[54] METHOD FOR THE FABRICATION OF SANDBLASTED COMPOSITE SIGNS

[75] Inventor: Gordon L. Brown, Jr., Bristol, Tenn.

[73] Assignee: Morrison Molded Fiber Glass Company, Bristol, Va.

[21] Appl. No.: 408,342

[22] Filed: Sep. 18, 1989

[51] Int. Cl.[5] ..... B24C 1/04; B24C 1/06; B32B 31/16

[52] U.S. Cl. ..... 156/154; 51/310; 51/319; 40/615; 40/616

[58] Field of Search ..... 156/154; 51/310–312, 51/319; 40/612, 616, 615, 596; 427/272

[56] References Cited

U.S. PATENT DOCUMENTS

| | | | |
|---|---|---|---|
| 1,720,567 | 7/1972 | Philip | 51/312 |
| 1,720,569 | 7/1929 | Philip | 51/312 |
| 2,345,942 | 4/1944 | Lehman . | |
| 3,751,319 | 8/1973 | Green et al. . | |
| 4,133,919 | 1/1979 | Parsons . | |
| 4,342,168 | 8/1982 | Schmanski | 40/616 X |
| 4,430,416 | 2/1984 | Goto et al. | 51/310 X |
| 4,587,186 | 5/1986 | Nakamura et al. | 51/310 X |
| 4,612,737 | 9/1986 | Adee et al. . | |
| 4,702,786 | 10/1987 | Tallman . | |
| 4,834,833 | 5/1989 | Palmer | 156/154 |

FOREIGN PATENT DOCUMENTS

| | | |
|---|---|---|
| 4716336Q | 1/1972 | Japan . |
| 52-26095 | 8/1975 | Japan . |

*Primary Examiner*—Michael W. Ball
*Assistant Examiner*—Jeff H. Aftergut

[57] ABSTRACT

The invention relates to a method of manufacturing a sign or similar article by providing a fiber reinforced plastic laminate structure having pre-selected dissimilar laminate layers. After sandblasting, the dissimilar materials that have been exposed present different textured patterns to the observer, and therefore allow the sign designer greater latitude in the design and layout of the sign. Portions of the sign material may extend outwardly or downwardly from the sign body, for connection to the ground or any other secondary support structure. The materials of construction of the sign apparatus significantly enhance the longevity of the structure, as compared to the sandblasted wooden structures currently being used which are subject to rot or decay.

1 Claim, 1 Drawing Sheet

METHOD FOR THE FABRICATION OF SANDBLASTED COMPOSITE SIGNS

RELATED APPLICATION

This application is related to application Ser. No. 408,343, Mr. Gordon L. Brown, Jr. inventor, filed Sept. 18, 1989.

BACKGROUND OF THE INVENTION

1. Field of the Invention

This invention relates to the sandblasting of a flat sheet of fiberglass composite to produce a sign, the sheet being masked in selected areas. A nickel or copper continuous strand mat could be included in the laminate structure of the composite and exposed during the sandblast operation if it is desired to install the sign in a submerged marine environment.

2. Description of the Prior Art

As disclosed in U.S. Pat. No 2,345,942 entitled "Wood Finishing", it is well known to use wood as a material for making sandblasted signs.

The pattern of the sign is selectively created in the wood surface by the use of a protective surfacing mask laid over the areas of the sign that should not be eroded by the impingement of the sandblast material, such as is disclosed in U.S. Pat. No. 4,702,786. As disclosed in this patent, the surfacing mask may also remain upon the wood surface after the sandblasting operation is completed, to form the exterior of the pattern.

Wood, of course, deteriorates rapidly when placed in an outdoor environment and plastic may be used as a sign material, as disclosed in U.S. Pat. Nos. 4,133,919 and 3,751,319, as well as Japanese Patent 00260905, (No. 50-101822). For example, the '319 patent discloses the fabrication of signs and other artwork that are made with a clear facing layer of polyester resin protecting one or more colored pattern layers. The pattern layers are applied by silk screening after the facing layer has cured to at least a tack-free condition. At the rear surface of the sign is applied a background layer of polyester resin and a stiff glass fiber backing layer. Japanese patent JA-4716336-Q discloses a method of selectively sandblasting a surface of a metal or a synthetic resin molding, whereas the '919 patent teaches sandblasting the surface of a glass or plastic sheet having rubber masking material thereon.

In Japanese Patent 52-26095 a plastic film is applied over a metal or plastic base material and thereafter selectively removed to expose the base material to a sandblasting operation.

Sandblasting may also be used in commercial structural applications, such as discussed in U.S. Pat. No. 4,612,737, wherein a sound attenuation product is produced by attaching a prepared maskant having a desired perforation pattern to a cured contoured or flat composite material. A narrow stream of highly abrasive grit material of a selected particle size range is then directed through a relatively large nozzle under selected high pressure toward the maskant perforations at a very small angle relative to the perforation walls until perforations are formed in the composite material according to the perforation pattern. The perforated sheet produced is particularly adapted for use in sound attenuation structures.

Whereas the above references discuss various sandblasting techniques to wood and/or plastic structures, none of the above references directly address a method or apparatus wherein the grain structure of the wood may be simulated, or at least aesthetically duplicated, in plastic.

A method of fabrication of a sign apparatus needs to be developed wherein the designer of the sign may select different surface textures for different surface areas on the face of the sign body.

SUMMARY OF THE INVENTION

The method of the present invention of fabricating a sign apparatus comprises providing a pultruded sign body having at least two dissimilar fiber layers dimensionally stabilized adjacent each other and bonded together by a hardened resin. The outer surface of the bonded layers is preferably masked in the desired pattern, and the unmasked area thereafter sandblasted to a depth sufficient to erode enough fibers and/or hardened resin from the layer(s) to yield an aesthetically pleasing surface having the pattern of the reinforcing fabric remaining after, or removed during, the sandblasting operation.

In other words if the fibers are softer than the hardened resin the sand blasted at the layer will remove the fibers and leave a "valley" pattern in the exposed surface. Conversely, if the fibers are harder than the resin, the sand blasted at the layer will remove the resin and leave the fibers in a "ridge" pattern. In either case, each layer will have a "predominate" pattern, whether it is a ridge pattern or valley pattern.

The sandblast operation may be intensified in certain areas so as to penetrate successive layers, each layer preferably having a different predominate pattern after sandblasting.

The sign apparatus, formed from a fiber reinforced plastic, still retains more than sufficient strength and rigidity after the sandblast operation to withstand hurricane force wind loadings of 200 lbs/sq. foot. The entire laminate structure may be designed to extend outwardly from the main body of the sign so as to attach the main body of the sign to a secondary support structure, such as the ground.

It should be noted that this composite sandblasted sign has already received an "Award of Excellence" from the Composites Institute of the Society of the Plastics Industry.

The patterns created by selective sandblasting of the various layers forming the sign body are unique and eye catching. They are similar to the signs that are seen today made out of wood which have been sandblasted. The patterns that are produced when the surface is sandblasted are directly related to the form of the reinforcement used to create the composite. Fiberglass continuous strand mat creates "valley" predominate patterns which appear as the texture of the continuous strand mat. Fiberglass continuous longitudinal rovings create longitudinal predominate "valley" patterns when subjected to sandblasting. In a similar matter, woven fiberglass creates a depressed woven pattern.

A nickel fiber mat could be used to fabricate marine signs, the exposed "ridge" pattern of the nickel fibers retarding the buildup of barnacles and other marine growth.

Carbon fiber forms (black) or Kevlar fiber forms (gold) could be used for their particular color and to impart specific properties, (example: carbon for high stiffness).

The base material for this sign (fiberglass composite flat sheet) is a structural member capable of supporting its own weight in an installed condition and also capable of having hardware mounted to it. As an example, the base portion of the sign could be installed directly in the ground with the above portion of the sign communicating the desired message. The portion of the sign in the ground would be corrosion resistant and would provide structural integrity for the portion of the sign above the ground.

It is therefore a feature of the invention to significantly cut the cost of sign installation and also allow the installed signs to last longer, especially in comparison to a wooden sign.

The flat composite sheet forming the sign body and the support structure can be pigmented with a variety of colors that allow the designer more freedom for creativity than wood. Also, as mentioned above, a variety of woven and non-woven fabrics can be used to create additional different and unique patterns. If a gray color is selected, the sand crafted sign will resemble the color and general texture of concrete. This would allow the sign to compliment the exterior of concrete buildings. If used outdoors, a clear coat of acrylic urethane paint will protect the laminate structure against ultraviolet attack, or if the sign is used indoors, no surface protection is needed.

These and other features, objects and advantages of the present invention will become apparent from the following detailed description, wherein reference is made to the figures in the accompanying drawings.

IN THE DRAWINGS

DETAILED DESCRIPTION

Figure 1:
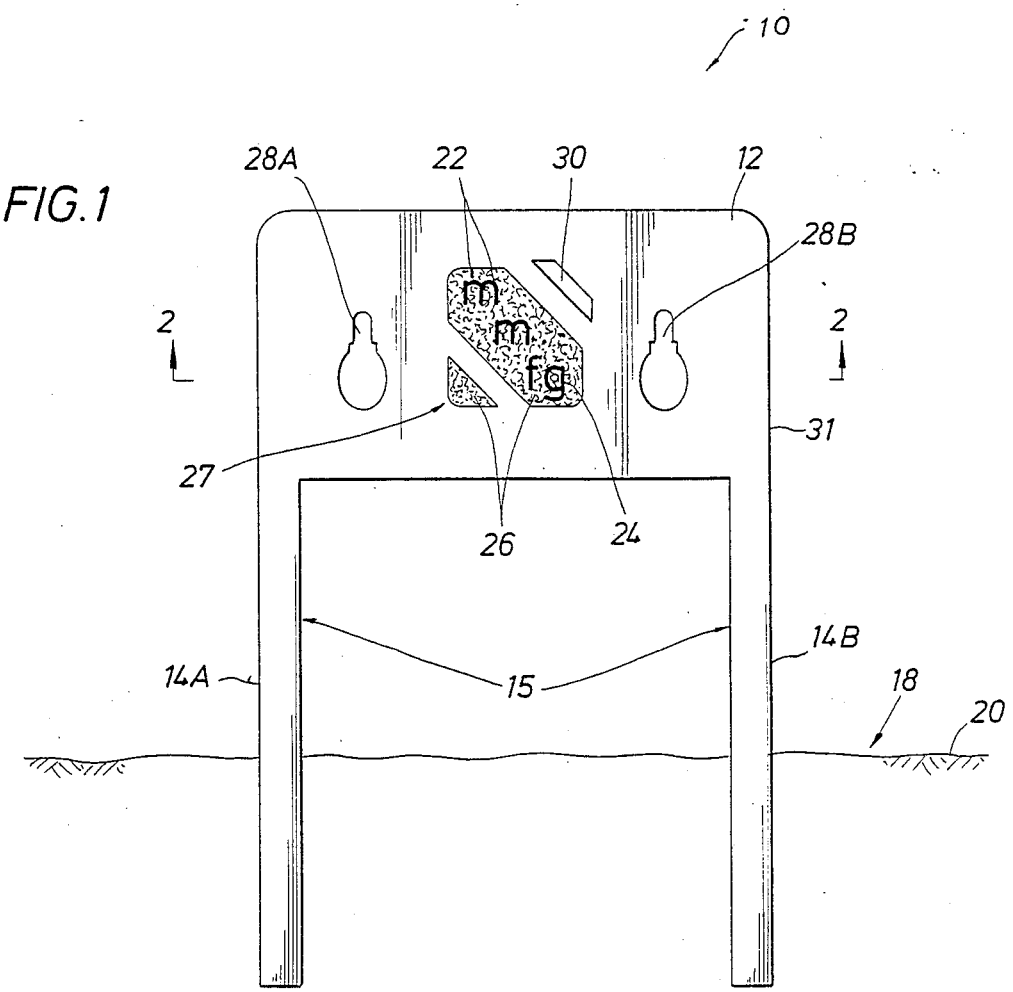
FIG. 1 is a schematic representation in a side view of the sign apparatus of the present invention.

Referring now to FIG. 1 a sign apparatus 10 is shown having a sign body 12 and primary support means 15 such as legs 14A and 14B, the legs operatively engaged to the sign body 12 and extending away from the sign body and capable of operative engagement to secondary support means 18 such as the ground 20.

The area of the primary support means 15 is typically less than the area of the sign body 12. It should be well understood that the primary support means may comprise a bolted mechanical fastener system for attachment to another mechanical support system, if it is desired not to attach the sign body 12 directly to the ground 20.

In one embodiment of the invention the Nexus surfacing veil surface 22 would first be covered by a vinyl-rubber type material to protect the surface 22, and then the area surrounding the surface would be sandblasted, leaving portions of the surface 22 in the shape of the desired letter(s) 24. Additional selective sandblasting may be used to form the continuous strand mat eroded surface 26 which typically will have a predominant "swirled" pattern 27 formed by the erosion of the fibers from the fiber/hardened resin matrix of the continuous strand mat.

In other words the "swirl" pattern is actually eroded areas where the fiberglass continuous strand mat used to be. The fiberglass continuous strand mat fibers are sandblasted away easier than the surrounding resin matrix and the "valley" pattern, (eroded depressed areas), is created.

A nickel fiber eroded surface 28A, 28B having a different predominant pattern than the other eroded surface 26 is shown exposed in a decorative manner on either side of the surface 26. The nickel fibers would form ridges after the sandblasting operation because the resin would be blasted away easier than the nickel fibers. It should therefore be well understood that the predominate pattern(s) generated by the sandblast operation can be pre-determined by the selection of the materials forming the sign body, as well as the allowed depth of penetration of the sandblast material.

The through opening 30 may be sandblasted entirely through the sign body 12.

Figure 2:
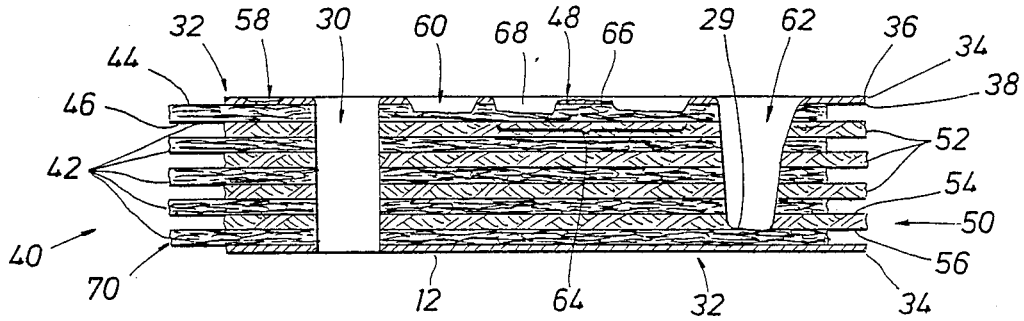
FIG. 2 is a schematic representation in cross-section taken along lines 2—2 of FIG. 1 of the sign body.

Referring now to FIG. 2, sign body 12 is shown in representative cross-section, again having through opening 30. Sign body 12 now includes NICOFIBER TM eroded surface 29 for the purpose of further discussion, the surface 29 being generated by sandblasting down through other layers of the body 12 until a layer of NICOFIBER TM continuous strand mat, (N720 Conformat continuous strand fiberglass mat, manufactured by Nicofiber Inc., Iron Point Road, Shawnee, Ohio 43782), is encountered. For the purposes of visual and labeling clarity alternating layers of the laminate materials are drawn preterminated at alternating ends of the layer. In the actual preferred embodiment the layers will terminate flush with one another at the outer edge 31, (FIG. 1), of the sign body 12.

Sign body 12 can therefore be seen to have at least one first laminate material means 32, in a preferred embodiment consisting of a polyester surfacing veil commonly called a Nexus veil 34 and having the "Nexus" tradename. This material is preferably used on the exterior of the sign body to give the exterior of the sign an extremely smooth outer surface. The Nexus veil can be seen to have a first outer surface 36 and a second surface 38 in a preferred embodiment defined parallel to the first outer surface 36. The Nexus veil has one predominant pattern, the predominant pattern being a particular visible surface fiber alignment characteristic of the particular laminate material used.

It should be well understood that the first laminate material means could also be a layer of continuous strand mat or a layer of roving of possibly nickel mat or some other mat.

Since the laminate material is dimensionally stabilized by a hardenable resin (not shown) it is well understood that the laminate material has interstitial cavities (not shown) defined therethrough filled at least partially with hardened resin, as is well understood in the art of composite fabrication. The hardened resin in a preferred embodiment can be isophthalic polyester resin, vinyl ester resin, orthophthalic polyester resin, or another thermoset resin such as phenolic resin or epoxy resin, the phenolic resin having fire retardant and low smoke properties.

The sign body 12 also includes at least one second laminate material means 40, in one embodiment comprising continuous stand mat 42 having a weight of 2 ozs/square foot and purchasable, for example, from Owens-Corning Fiberglass Corporation, material number M8641. The second laminate material means 40 can be seen to have a first surface 44 and a second surface 46 in a preferred embodiment defined parallel to the first surface 44. A portion of the first surface of the second laminate material means is operatively laminated in a preferred embodiment by the pultrusion process against a portion of the second surface 38 of the first laminate material means. The second laminate material means, (the continuous strand mat), in a preferred embodiment has a second predominant pattern 27, (FIG. 1), dissimilar from the first predominant pattern of the Nexus veil 24. The continuous strand mat, as is well known to the art, will also have interstitial cavities defined therethrough filled with hardened resin, the hardened resin being commonly interspersed throughout the first laminate material means and the second laminate material means interstitial cavities.

The sign body 12 can also be seen to include at least one shaped opening 48 defined downwardly into the first laminate material means 32.

In one embodiment of the present invention the sign body would include the first laminate material means 32 and the second laminate material means 40 to give the sign designer a choice of dissimilar predominant patterns that could be exposed to view. In a preferred embodiment however, the sign body 12 would also include one third laminate material means 50 comprising fiberglass continuous roving 52 at 113 yd/lb. yield at a 2" horizontal spacing. The inclusion of the third laminate material means would give the sign designer a third dissimilar predominant pattern to choose from during the design and subsequent fabrication of the sign body 12. As before the third laminate material means would have a first surface 54 and a second surface 56 in a preferred embodiment defined parallel to the first surface 54. A portion of the first surface would be operatively laminated against a portion of the second surface 46 of the second laminate material means, the third laminate material means as before having interstitial cavities defined therethrough with hardened resin commonly interspersed therethrough.

The designer of the sign may decide to merely sandblast a portion of the Nexus veil 34 away so as to form a first laminate opening 58. The designer may also choose to extend the first laminate opening 58 downwardly into a portion of the second predominant fiber pattern and thereby form second laminate opening 60. The designer may also choose to define the opening entirely through the second predominant fiber pattern downward to a lower layer such as by forming the NICOFIBER opening 62. Alternatively, a sandblast apparatus may be held in position long enough to blast an opening entirely through the sign body 12 such as through opening 30.

During the formation of a letter 24 the designer in a preferred embodiment would define an opening downwardly through the first laminate material means and a portion of the second laminate material means, the bottom 64 portion of the shaped opening contoured to include a first laminate eroded surface 66 and a second laminate eroded surface 68. The letter 24 (FIG. 1) would be formed by a properly shaped portion of the Nexus veil.

In an alternative embodiment one of the layers of the second laminate material means, may be selected to comprise continuous strand nickel fiber mat, (as discussed earlier), manufactured from nickel fibers by National Standard Co., 236 Timber Creek Lane, Marietta, Ga. 30060, which may be used for reflective purposes on the viewed surface of the sign.

In operation a pultruded sign body is provided having a hardened composite structure including at least one first laminate material means and at least one second laminate material means. A mask is thereafter formed for overlayment onto the first outer surface 36 of the first laminate material means. As described in U.S. Pat. No. 4,702,786 a conventional "mask" material or laminate which is normally used in sandblasting operations includes paper, plastic carrier ply, an adhesive ply, and a mask ply formed of relatively tough plastic material which is resistant to sand or like particulate material used in a conventional sandblasting operation.

A conventional computer-controlled cutting machine, such as the GRAPHIX 4 machine manufactured by Gerber Scientific Products Inc. of 151 Batson Drive Manchester, Conn. 06040, may be used from which letters, numbers, designs, logos, etc. are struck from the plys. The laminating mask is thereafter positioned onto the first outer surface 36 and then releasably adhered to the first outer surface. The desired areas are sandblasted, the areas underlying the mask being unaffected during the sandblasting operation as is well known to the art, and thereafter the masking laminate is removed at the completion of the sandblasting operation.

Sandblast grit material is thereafter provided, the material having the capability of blasting through a portion of at least one of the laminate material means while retaining the laminating mask on the first outer surface 36. In a preferred embodiment silica sand (fine grain 6×) may be used. In blasting the sign body 12 it required approximately 30 lbs/sq. foot of fine grain 6× sand to achieve a depth of blast between 1/32 and $\frac{1}{8}$ of an inch. The type of sandblaster used was a Grimmer-Schmidt with a compressor rated at a 100 cubic ft/min. and 100 psi continuous pressure with a 3/16" ceramic nozzle. The grit material is thereafter blasted against at least one of the laminate material means, visually exposing the predominate pattern of that particular laminate material means.

It should be well understood that the mask may be formed from a rubber self-adhering stencil, or a vinyl material. It is well understood that the grit material may be aluminum oxide or silica sand or the like having hard, sharp, abrasive grains.

The step of blasting the grit material against at least one of the laminate material means in a preferred embodiment further includes the step of eroding a portion of the first laminate material means and a portion of the second laminate material means to form at least one shaped opening having the bottom 64 portion including a first laminate eroded surface 66 and a second laminate eroded surface 68. The surfaces 66, 68 may be formed by initially placing a mask on the surface 66, eroding around the surface 66 to a partial depth of the eroded surface 68, thereafter removing the mask from the surface 66 and thereafter commonly blasting both surfaces 66, 68 to expose the fiber pattern for example of the Nexus veil, and also to deepen the opening 48 formed in the eroded surface 68. During the sandblast operations on surfaces 66, 68, it is well understood that the openings 60, 30, 62, 58 may also be started downward through the sign body 12 by proper application of masking material adjacent these openings.

The sign body 12 in a preferred embodiment has the particular laminate layer sequence of Nexus veil, continuous strand mat, and rovings, and is produced in thicknesses of $\frac{1}{8}$", 3/16", $\frac{1}{4}$", $\frac{3}{8}$", $\frac{1}{2}$", $\frac{5}{8}$", $\frac{3}{4}$" and 1" thicknesses by Morrison Molded Fiber Glass, Box 580, Bristol, Va. 24203. The particular structure shown in FIG. 2 has a nominal thickness of $\frac{1}{4}$". The sign body material may be pigmented during manufacture by Morrison Molded Fiber Glass, (MMFG), such that the MMFG Series 500 sign body would have an olive green color, the MMFG Series 525 a haze gray color and the MMFG Series 625 a beige color.

An advantage of the invention, that of using a fiberglass composite laminate structure, lends itself to automation because the laminated structure is consistent as to erodability. Whereas the sandblasting of wood must be closely operator controlled because of the natural variability in wood which produces hard and soft spots such that the operator needs to visually see how much the wood is being blasted away in order to produce a consistent sandblasted wooden product, the fiberglass sheet erodes in a controlled manner during the sandblasting operation and therefore does not need to be monitored by an operator.

Additionally, fiberglass flat sheet is much stronger than wood and generally has a tensile strength four times that of redwood, a flexural strength of 2 times that of redwood and the rigidity or stiffness of 1.25 times that of redwood.

Morrison Molded Fiber Glass' manufacturing process is capable of producing a flat sign body up to 54 inches wide and of a length that would only be limited by shipping constraints.

Many other variations and modifications may be made in the apparatus and techniques hereinbefore described by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. A method of fabricating a sign apparatus comprising the steps of:

providing a sign body having;

at least one first laminate material means having a first outer surface and a second surface defined parallel to said first outer surface and having one predominant fiber pattern and interstitial cavities defined therethrough, at least one second laminate material means having a first surface and a second surface defined parallel to said first surface, a portion of said first surface of said second laminate material means bound to a portion of said second surface of said first laminate material means, said second laminate material means having a second predominant fiber pattern dissimilar from said first predominant pattern and having interstitial cavities defined therethrough, and hardened resin commonly interspersed throughout said first laminate material means and said second laminate material means interstitial cavities and commonly interspersed between said first laminate material means and said second laminate material means, to form a continuous mass throughout and between said material means, dimensionally stabilizing said fiber patterns and binding said material means together, said resin being homogeneously erodible, providing a grit material having the capability of blasting through a portion of said erodible hardened resin, and blasting said grit material against said homogeneously erodible hardened resin to erode said resin sufficiently to visually expose at least one of said predominate fiber patterns.

* * * * *